US006991111B2

(12) United States Patent
Lilja et al.

(10) Patent No.: US 6,991,111 B2
(45) Date of Patent: Jan. 31, 2006

(54) FLOTATION MECHANISM AND CELL

(75) Inventors: Launo Leo Lilja, Pori (FI); Bror Göran Nyman, Ulvila (FI); Heikki Tapani Oravainen, Helsinki (FI)

(73) Assignee: Outokumpu Technology Oy, Espoo (FI)

( * ) Notice: Subject to any disclaimer, the term of this patent is extended or adjusted under 35 U.S.C. 154(b) by 9 days.

(21) Appl. No.: 10/490,590

(22) PCT Filed: Oct. 10, 2002

(86) PCT No.: PCT/FI02/00774

§ 371 (c)(1),
(2), (4) Date: Mar. 23, 2004

(87) PCT Pub. No.: WO03/035265

PCT Pub. Date: May 1, 2003

(65) Prior Publication Data

US 2004/0245151 A1 Dec. 9, 2004

(30) Foreign Application Priority Data

Oct. 4, 2001 (FI) ..... 20011940

(51) Int. Cl.
*B03D 1/14* (2006.01)
*B03D 1/16* (2006.01)

(52) U.S. Cl. ..... 209/169; 209/168

(58) Field of Classification Search ..... 209/168, 209/169; 261/87
See application file for complete search history.

(56) References Cited

U.S. PATENT DOCUMENTS

| | | | | |
|---|---|---|---|---|
| 2,733,809 A | * | 2/1956 | Wrege et al. | 209/166 |
| 3,343,674 A | * | 9/1967 | Zandon et al. | 209/166 |
| 3,491,880 A | * | 1/1970 | Reck | 209/164 |
| 3,843,101 A | | 10/1974 | Green | 259/96 |
| 5,219,467 A | | 6/1993 | Nyman et al. | 209/164 |

FOREIGN PATENT DOCUMENTS

| | | | |
|---|---|---|---|
| WO | 97/06892 | * | 2/1997 |
| WO | WO 02/07890 | | 1/2002 |

* cited by examiner

*Primary Examiner*—Thomas M. Lithgow
(74) *Attorney, Agent, or Firm*—Morgan & Finnegan, LLP

(57) ABSTRACT

The present invention relates to a froth flotation mechanism located in a flotation cell, comprising a directional element suspended from the lower end of a hollow shaft extending to the lower section of the cell and vertical vanes attached to said directional element, which extend above and below the directional element and horizontally beyond the directional element. The substantially horizontal circular plate of the directional element is symmetrically attached around the shaft at its centre and the outer edge of the central plate is bent downwards to form the lap of the guiding part. The gas spreading plate is located on the inner side of the lap. The flotation cell is comprised of a cylindrical lower section, a middle section located above it in the form of a truncated cone widening upwards, and a cylindrical upper section attached to the top of it.

13 Claims, 3 Drawing Sheets

FLOTATION MECHANISM AND CELL

The present invention relates to a froth flotation mechanism located in a flotation cell, comprising a directional element suspended from the lower end of a hollow shaft extending to the lower section of the cell and vertical vanes attached to said directional elements, which extend above and below the directional element and horizontally beyond the directional element. The essentially horizontal circular plate of the directional element is symmetrically attached around the shaft at its centre and the outer edge of the central plate is bent downwards to form a lap of the guiding part. A gas spreading plate is located on the inner side of the lap. The flotation cell is comprised of a cylindrical lower section, a middle section located above it in the form of a truncated cone widening upwards, and a cylindrical upper section attached to the top of it.

Flotation cells may be mixing vessels, single, in series or in parallel. They may be either rectangular or cylindrical in shape, in horizontal or upright position. Gas is routed through the hollow mixing shaft to an usually small rotating rotor on the bottom. The rotor causes a powerful suction as it rotates, which sucks the gas into the rotor space. There the slurry is mixed with the gas bubbles discharging and dispersing via the shaft. Usually a stator built of vertical plates is installed around the rotor, which promotes gas dispersion and attenuates the rotation of the slurry. Mineral particles that have adhered to the gas bubbles rise from the stator to the surface of the froth layer and from there out of the cell into the froth channels.

Nowadays it is becoming increasingly common to use upright cells, which are still cylindrical and normally flat-bottomed. One problem with flotation cells is sanding, i.e. solid matter piles up on the bottom of the cell in an immovable layer. This is usually due to a too small or ineffective rotor, as in such a case the mixing zone of the rotor does not extend far enough. Another common difficulty is that the mineral particles already attached to the gas bubbles cannot be removed from the flotation cell, because the flows forming in the cell and particularly at its surface and upper section are wrongly oriented or too weak i.e. they are not able to move the frothed gas bubbles out of the cell.

A flotation mechanism is known in the prior art according to U.S. Pat. No. 4,078,026, where the gas to be dispersed is conveyed via a hollow shaft to the inside of a rotor revolving in said shaft. The rotor is designed in such a way as to preserve a balance between the hydrostatic and dynamic pressure, that is, the vertical section of the rotor is a downward narrowing cambered cone. The rotor has separate slurry ducts for slurry and gas.

Figure 3:
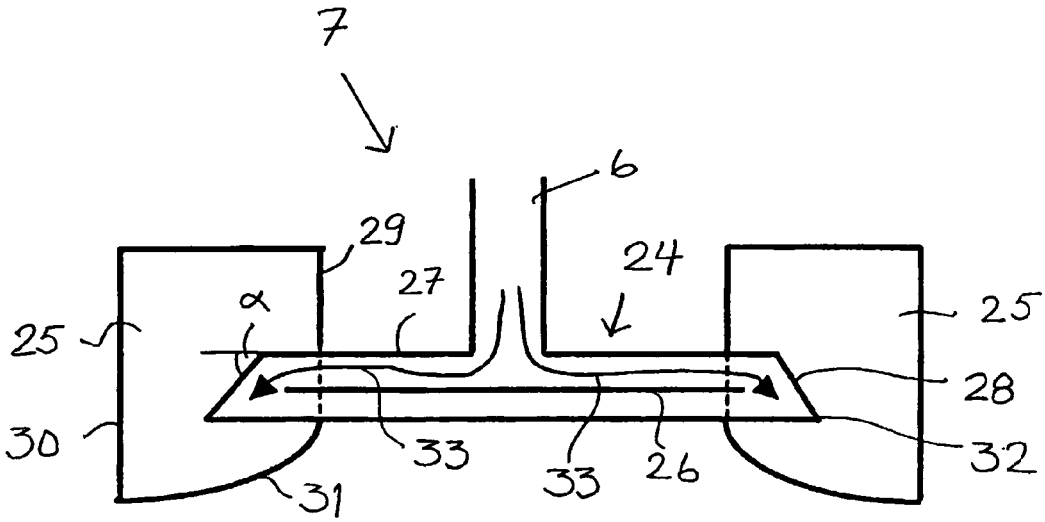

The Svedala mechanism described in EP patent 844 911 consists of a mixer fixed to an vertical shaft for mixing gas and slurry. In this mixer there are several vertical plates radially around the shaft and between the plates there is a horizontal baffle around the shaft, with a width of about half that of each plate. Gas enters below the baffle. The parts of the mixer above the baffle cause first a downward flow, which then at the baffle becomes an outward flow and correspondingly the parts below the baffle cause first an upward and then outward flow, as shown in FIG. 3 of the patent. The outer edges of the upper parts of the mixer blades are straight, but in the lower section they narrow inwards in a concave fashion. There is a stator around the mixer.

U.S. Pat. No. 5,240,327 describes a method of mixing different phases particularly in a conditioning cell. In addition to the method, the patent describes the zones created in the reactor and how to achieve a controlled flow dynamic zone distribution. The patent describes a cylindrical, flat-bottomed upright reactor, wherein are vertical baffles in order to attenuate the turbulence of the slurry. In addition the reactor has a ring-shaped horizontal baffle (back-flow guiding member) in order to guide the vertical flow and divide the reaction space in two. The patent further describes a special mixer with which to obtain the desired flow dynamics. This arrangement thus enables the formation of a double toroid in the section below the horizontal guiding member thanks to the combined effect of the horizontal guiding member and the mixer and in the double toroid the slurry fed into the lower section first swirls in the lower bottom toroid and then gradually moves to the upper toroid. From here the well-mixed dispersion rises into the pacified and controlled flow zone situated above the guiding member and is then removed via an overflow aperture. The double zone model described in the patent is suitable for normal chemical reactions and particularly for the flotation and conditioning of mineral concentrates.

A mineral slurry conditioning-flotation cell is known from U.S. Pat. No. 5,219,467, which is in some way a further development of the method and equipment in the patent mentioned above. The apparatus comprises a colon-like reactor, in which concentration takes place in three separate zones. The reactor is equipped with vertical flow guides, a horizontal flow attenuator and a mixer. The gas is routed through the hollow support arms to behind the dispersing vanes of the mixer. Flotation reactions are created in the bottom zone, from where gas bubbles and mineral particles carried by them are directed to the surface of the apparatus. The apparatus is designed so that a strong agitation can be used in the bottom zone without harming the separation of the froth in the upper zone.

Now a new and improved flotation mechanism has been developed, which achieves an extremely powerful agitation (high power number) in the whole coverage area of the mixer. The power number $N_p$ is known as the dimensionless number related to the mixer and sometimes also to the cell structure. As well as the power number $N_p$, also the density $\rho$ of the slurry to be mixed, the speed of rotation n and the diameter of the mixer d affect the power offtake P of the mixer ($P=N_p \rho n^3 d^5$). The bigger the power number of the mixer, the greater the degree of turbulence obtained and likewise naturally the greater the energy density required for flotation. The mechanism i.e. the mixer disperses the flotation gas into very fine bubbles with the effect of its vertical vanes, which is also predictable from its power number.

The flotation mechanism is comprised of a directional element, vertical vanes and a gas-spreading element. The directional element is symmetrical and is fixed at the centre to the lower section of the hollow shaft of the mechanism. The gas-spreading element is positioned below the directional element and its task is to spread the gas fed via the flotation mechanism shaft and direct its direction radially before the gas is mixed into the slurry suspension. Thanks to the directional element that is bent cylindrically at the outer edge, the mixer directs the gas-slurry suspension in a downward slanting direction towards the inner wall of the lower section of the cell. The vertical vanes extend sideways beyond the directional element as well as above and below it. The mixer sucks in the slurry from both above and below and mixes it effectively into the gas bubbles formed. The flotation mechanism according to the invention fulfils all the requirements set for mechanisms of the prior art. In addition, as well as being efficient, the mixer construction is balanced, strong and especially yet simple.

The flotation cell that is very suitable for use with the mechanism of this invention, can be called a "vase cell" (DTR) due to its shape. The cell is comprised typically of a cylindrical lower section, a conically upward-widening middle section and a cylindrical upper section. The majority of the energy caused by the mixer is used in the lower section of the cell, i.e. the mixing section, for chemical reactions and keeping the bottom clean of solid particles. The rest of the energy assisted by the gas bubbles is used for directing the flow of mineral particles attached to the gas bubbles from the centre of the cell upwards towards the froth surface. Naturally, this upward flow tries to be constricted due to the agglomeration tendency of the gas bubbles, but with the correctly chosen widening middle section and at the height of the wider upper section, the flow can be made to achieve its optimal width and a surface flow can be created in the desired direction, from the centre of the cell to the edge. The height of the cylindrical lower section is preferably ¼–¾ of the total height. With an efficient rotor and vertical baffles in the lower section the desired energy density/turbulence required for the flotation reactions can be achieved. When a flotation mechanism according to the invention is placed in the flotation cell in question, the correct flow pattern and a high power number can be obtained, even though the cell has no horizontal guide or stator. There are several cases where a large energy capacity is required in order for the reactions to succeed.

The essential features of the invention will become apparent in the attached claims.

In ordinary cylindrical cells the efficiency required is of course achieved mainly near the mixer. However, the range of the energy area is usually restricted, whereby sanding, i.e. a build-up of ore slurry, begins to form on the outer edges of the cell floor. For example, the diameter of a cell in cells of over 100 $m^3$ can easily exceed 5 meters. In this case, a mixer is required for the effective cleaning of the bottom of the cell with a diameter of the order of 2 meters, which weakens the strength and durability of the mixer. A flotation cell, where the volume and thus the diameter of the lower section are essentially smaller than the upper section of the cell, is clearly more practical particularly in situations where flotation is carried out in large cells. This means that the size of a rotor with a high power number remains reasonable. Normally the diameter of the mechanism in flotation is around 25% of the diameter of the cell.

The flotation mechanism of the present invention can be named L3+. The purpose of the apparatus of the invention is to disperse the flotation gas into small bubbles evenly distributed in the slurry, to develop a strong turbulence in the immediate range of the mixer i.e. mixing efficiency and to prevent at the same time coarse particles from descending to the floor of the flotation cell. The mixing efficiency is several kilowatts per cubic meter of slurry. The flotation cell is not equipped with a horizontal guide, but thanks to the selected cell construction and an effective mechanism the guided central flow raises the mineral particles to the froth layer on the surface. The mineral particles are then guided from the froth layer out of the cell radially with the froth over the froth edge of the upper section of the cell into the froth channels. The horizontal ring has the drawback that material may accumulate on top of it.

The cell according to this invention comprises three sections: a cylindrical lower mixing section, a section located above it forming a rising flow in the direction of the shaft, in other words a basically truncated cone that widens upwards, and a cylindrical upper section, wider at the bottom for the rise of the evened minerals. The angle of the truncated cone of the middle section to the vertical axle is preferably 30–60°. The cell includes at least four, but advantageously eight vertical baffles particularly suitable for mixing in the lower section. The baffles preferably do not extend sideways beyond the circumference of the lower section.

As stated earlier, the flotation mechanism comprises three sections: a directional element, a spreading element and vertical vanes. The directional element is symmetrical and is attached at its centre to the lower end of the hollow shaft of the mechanism. The central part of the directional element i.e. the part directed upwards from the shaft, is a horizontal circular plate, which is bent downwards at the outer edge in the shape of a truncated cone. The outer edge that is bent downwards forms an angle with the horizontal of preferably 30–60° and this directional element lap forms the actual guiding element.

Vertical vanes, at least four in number, preferably six, are attached to the directional element. The vertical vanes extend above and below the directional element and horizontally preferably beyond the outer edge of the directional element. The width of the vanes is preferably greater than that of the conical lap of the directional element and thus the inner edge of the vertical vane reaches the horizontal plate. The vertical vane extends beyond the directional element for a distance that is preferably ⅓–⅔ the width of the directional element lap. Below the directional element is the spreading element, which is intended to alter the direction of the gas discharging from the lower end of the shaft to spread it our radially. The spreading element is preferably at a suitable distance from the horizontal plate of the directional element and plate-like in form.

The outer edge of the flotation mechanism vertical vanes is substantially vertical and because it extends beyond the outer edge of the directional element, the flotation gas-dispersing properties of the vanes can be utilised so effectively as possible, i.e. the maximum underpressure is generated behind the vanes and the dispersion range of the vanes is enlarged with the part extendind beyond the directional element. The inner edge of the vane is vertical at the top, but narrows in a curve at the bottom, thereby reducing wasted energy loss. The advantage of a downwardly narrowing vane is also the fact that the mechanism is easy to restart after a stop, regardless of any settling slurry around it.

Unlike many flotation mechanisms, both the cell and the mechanism of the present invention work without a costly and easily wearing stator.

The invention is described in more detail in the attached drawings, where

Figure 1:
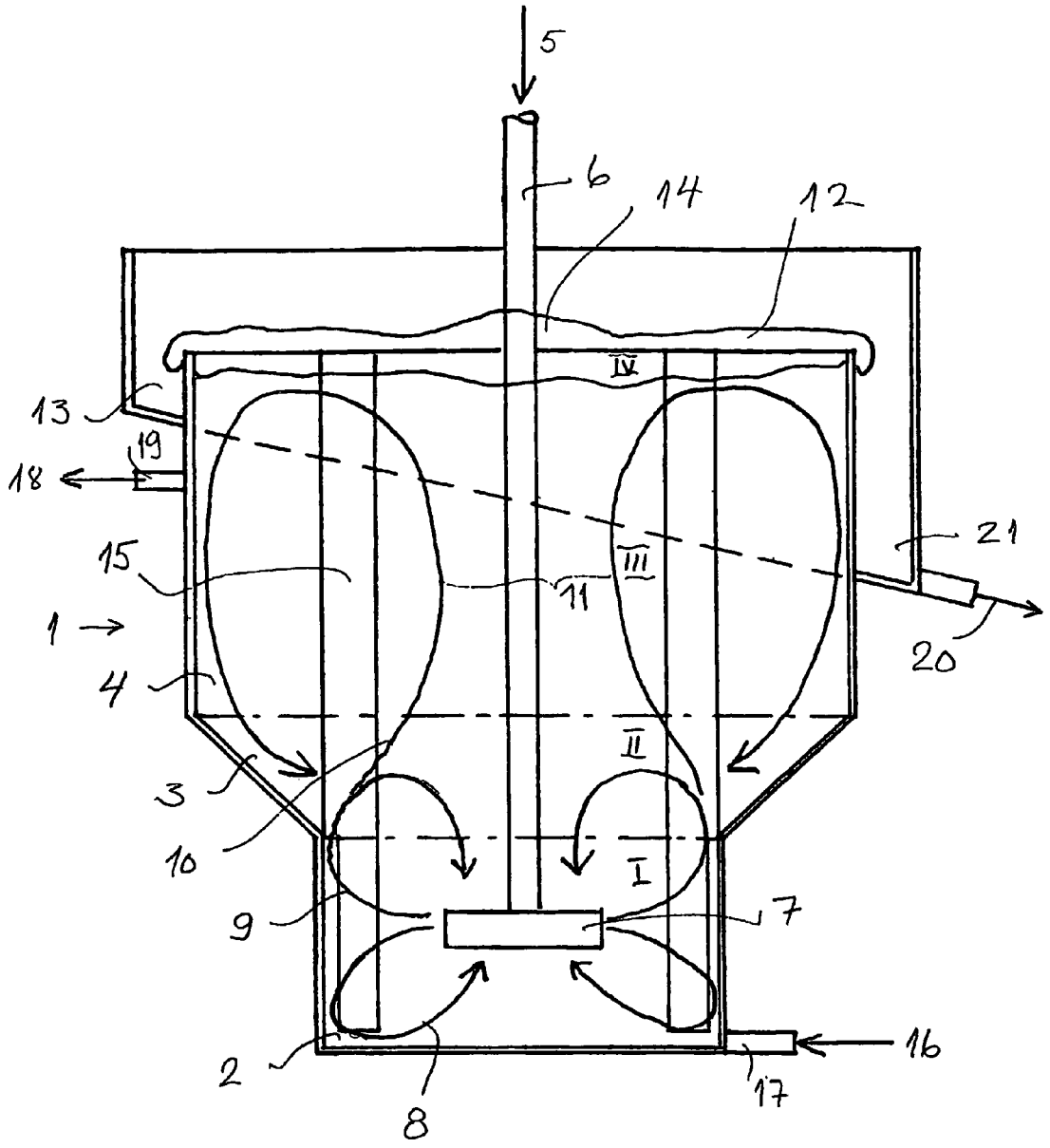
Figure 2:
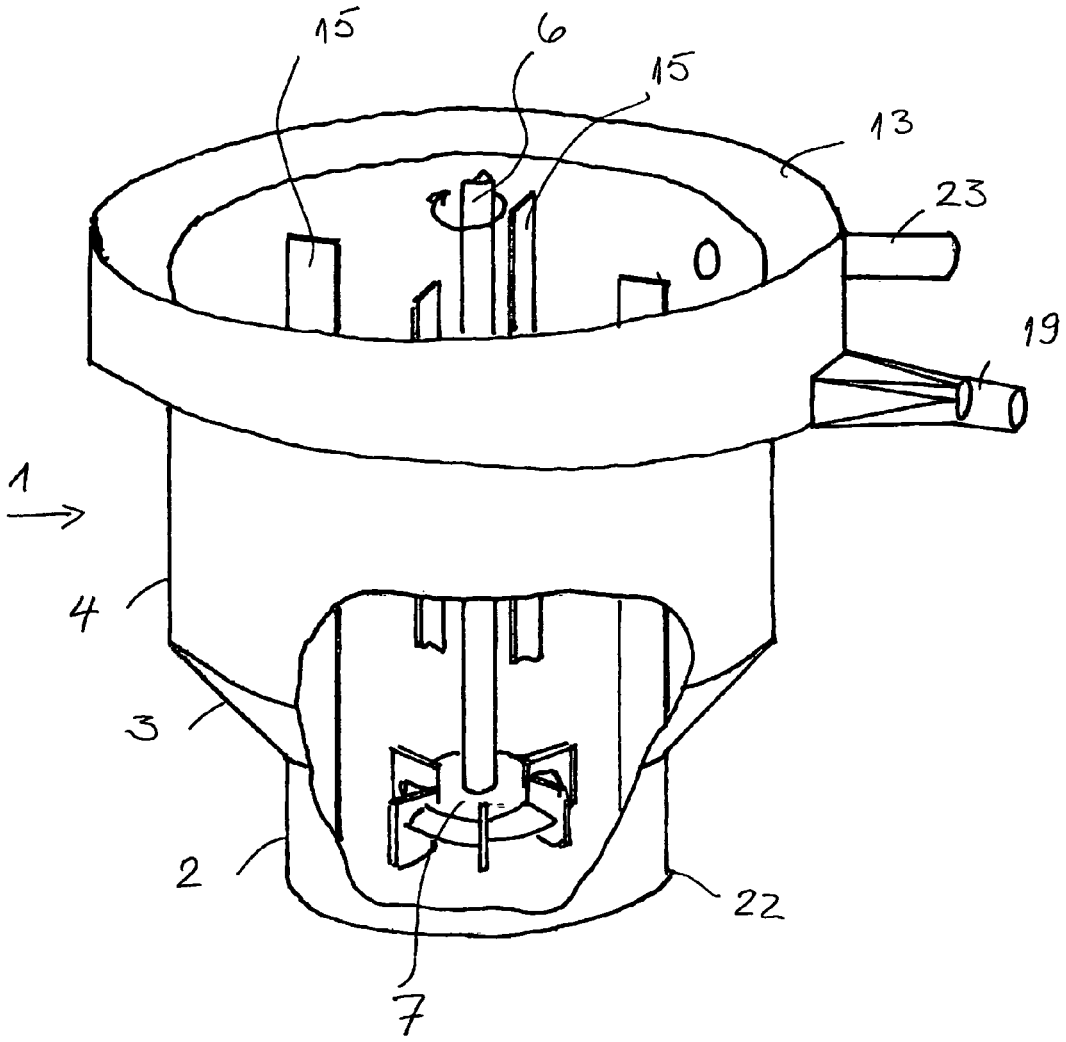

FIG. 1 is a flow pattern of the flow achieved in an upwardly widening flotation cell with the mixer of the invention, FIG. 2 is an oblique axonometric illustration of an upwardly widening flotation cell seen in partial cross-section, and FIG. 3 is a vertical section of the L3 mixing mechanism of the invention.

In FIG. 1 the different zones in a flotation cell 1 are marked with Roman numerals. Zone I is a mixing zone with great energy density, formed in a cylindrical lower section 2 with a diameter of between ⅓–⅔ of the diameter of the upper section of the flotation cell. Zone II is an upward flow formation zone, formed by a widening middle section, largely in the shape of a truncated cone 3. Zone III is the discharge and attenuation zone of the upward flow, formed in a cylindrical upper section 4 of the flotation cell, where the diameter of the cell is at its widest. Zone IV is the froth zone.

Gas 5 is fed into the mainly upright cylindrical flotation cell 1 through a hollow shaft 6 of a flotation mechanism 7 of the invention, which mechanism is situated in the lower section 2 of the cell near the cell floor. When the mixer 7 rotates at the bottom end of said shaft 6, it causes an effective dispersion of the gas into small bubbles, which are mixed into the slurry suspension that is flowing both upwards and downwards from outside the mixer. Due to the effective directional impact of the mixer this gas-liquid-solid suspension is guided towards the sidewalls of the cell. The great powerfulness of the mixer of the invention and the concentration in just mixing zone I is a prerequisite for the effective dispersion of gas, and for the mixing of slurry and gas. In addition, the great power of the mixer in the mixing zone is also a precondition for the reactions related to flotation, and in particular for the kinetics of the reactions. Near the wall of the cell the flow divides into two toroidal flows; of which the lower vortex 8 circulates near the floor of the cell as it returns to the middle section below the mixer and the other correspondingly flows above and back to the mixer as the upper vortex 9.

Part of the upper vortex 9 branches upward to rise as a partial flow 10 to the upward flow formation zone II. This is achieved not only by the powerful directional effect of the mixer, but also as a result of the upwardly widening cell construction. In the upward flow formation zone II the whole of the upward suspension flow, which contains mineral particles attached to the gas bubbles, is collected and concentrated in a central shaft area II of the cell. This method ensures that the remaining flow energy is utilised so that an adequate flow from the centre of the cell outwards is generated in the discharge and attenuation zone III, in other words in the cylindrical upper section 4, so that the direction in question is also maintained in froth layer 12, i.e. zone IV. The attenuation zone, where the energy of the flow is evened, is also necessary so that specifically the concentrate rising with the bubbles is transferred to the froth layer, rather than some other slurry stirred up by the powerful agitation. The mineral particles that have risen to the froth layer move to froth collection channels 13 surrounding the cell. The effectiveness of the froth transfer and the correct orientation of the mixing are seen in an upsurge 14 of the froth layer near the shaft.

The horizontal circulation and possible vortex formation of the slurry is attenuated with plate-like vertical guiding elements or vertical baffles 13, of which there are at least 4, but preferably 8. In addition, the baffles are preferably wider than normal and in this case dimensioned according to the lower section 2 of the cell and thus they extend, not only in the lower section but in particular in the upper section, more than normal to the centre inside the cell. The ore slurry 16 to be processed is fed from the lower section of the cell via a feed unit 17 into the range of the mixer. Waste 18 is removed from zone III via discharge outlet 19. Froth 20 is removed from the lower part of a channel 21. It should be noted that it is important to keep mineral particles in the flow all the time once they have been floated and to discharge them from the cell into the channel. This is possible precisely because of the flow dynamics control described above and because there are no longer any obstacles in the upper section of the cell i.e. no solid elements to break the bubbles and weaken their carrying capacity.

FIG. 2 illustrates in more detail a flotation cell 1, which is upright, comprising two cylindrical sections; a lower section 2 and a wider upper section 4 and the widening section 3 joining them. The lower section is flat-bottomed or slightly rounded at the lower edge 22. The drawing shows the froth channel 13 and its discharge outlet 23. The waste outlet pipe 19 and vertical baffles 15 are also shown. The flotation mechanism 7 of the invention is located on the hollow shaft 6 in the lower section 2 of the cell, the mixing zone.

FIG. 3 is a cross-section of the flotation mechanism 7 of the invention attached to a hollow shaft 6, which operates as the gas feed device. The flotation mechanism comprises three sections: a directional element 24, vertical vanes 25 and a gas-spreading element 26. The directional element 24 is symmetrical and attached at the centre to the lower part of the hollow shaft 6 of the mechanism. The central section of the directional element i.e. the part oriented outwards from the shaft is a horizontal circular plate 27, which is bent downwards at its outer edge in the shape of a truncated cone. The downward inclined outer edge forms angle $\alpha$ with the horizontal, preferably between 30–60°, and this lap 28 of the directional element forms the actual guiding part. The width of the directional element lap 28 is ½–⅙ of the diameter of the whole directional element.

Attached radially to the directional element 24 are the upright vanes 25, numbering a minimum of four, preferably six. The upright vanes extend in the vertical direction above and below the directional element and laterally beyond the outer edge of the directional element in order to improve the power number and dispersing capacity. The width of the vane 25 is advantageously such that the inner edge 29 of the vane extends as far as the horizontal plate of the directional element, that is, past the inner edge of the bent lap 28. The outer edge 30 of the vane is essentially vertical, enabling the most effective dispersion of flotation gas, i.e. the maximum underpressure is generated behind the vane. The inner edge 29 of the vane is vertical at the top, but narrowing in an outward curve at the bottom 31 and designed this way with the purpose of minimising energy loss. The curve preferably follows the shape of the arc of a circle, where the centre point 32 of the circle is the intersection of the outer edge of the directional element lap 28 and the vertical vane 25.

The gas-spreading element 26 is fitted to the inside of the directional element lap 28 with the purpose of spreading and directing the flotation gas from the shaft 6 into an essentially radial direction. The spreading element 26 can be attached to the vertical vanes 25 or to the circular plate 27. The spreading and turning of the gas occurs as indicated by the arrow 33 before the gas is dispersed into the mineral slurry. As the amount of gas increases and/or the gas speed increases, from time to time pressure pulses are generated on the flotation mechanism. The spreading element helps to avoid these pulses. The spreading element 26 at its simplest is a plate with a diameter at maximum the same as that of the circular plate 27 and at minimum the size of the gas inlet i.e. the inner diameter of the shaft 6. The distance of the spreading element from the circular plate is preferably between ½–⅙ of the diameter of the gas inlet 6.

When the gas is sucked/forced downwards along the hollow shaft and directed under the circular plate 27 of the directional element, the gas mixes into the slurry flow that is rising from the space below the mixer towards the mixer. The mixed gas-slurry flow turns parallel with the circular plate 27 spreading outwards. Due to the effect of the downward turned outer lap 28 of the directional element, the flow is further turned in a downward slope as desired. Thanks to the strong underpressure created behind the upright vanes 25 of the mixer, the gas is dispersed into small bubbles. The vanes form a smooth, narrow flow field below the mixer to the flow coming from below. Said flow and the gas dispersed in it is joined by a flow of slurry coming from above the mixer, which is also turned in the same downward sloping direction thanks to the directional element lap 28. Thus directed, the whole combined suspension flows away from the mixer as a jet.

The invention is illustrated further by the following example.

Example 1

A comparative study was made between two different cases.

a gls rotor, that is a flotation mechanism and cell according to U.S. Pat. No. 4,548,765 and an L3+, in other words a flotation mechanism and cell according to the present invention.

Table 1 presents the measured comparative values. The gls mixer was taken as reference mixer. The rotors were without a stator.

TABLE 1

Relative values of test results.

| | Cell structure | Rotor (mixer) | Measured relative power number $N_p/N_p$(gls) |
|---|---|---|---|
| U.S. Pat. No. 4,548,765 | BTR | gls | 1.0 |
| This invention | DTR | L3+ | 3.4 |

BTR=An equal diameter flat-bottomed upright cell, with eight (8) vertical baffles and one (1) horizontal baffle. DTR=a "vase cell", according to the present invention, where the cylindrical lower section is smaller than the cylindrical upper section and in which cell there are eight (8) vertical baffles but no horizontal baffle.

The gls rotor functions, but the upward flow occurring in the centre was too widely distributed i.e. weak in strength, so that a beneficial central flow was not always achieved in the cells, since the buoyancy of the bubbles started to overcome the impulse strength of the slurry flow.

The L3+ rotor of the present invention functions in all conditions as desired: it raises the flow from the centre up to the surface and transfers the froth into the channel around the cell. This is shown in the power. First of all the power take-off or $N_p$ number is greater with the mechanism of the present invention (L3+) than with the first rotor. Secondly, the desired direction is intensified and extra energy is gained in zone II, the concentration zone of the upward flow. Thirdly, this extra energy or intensified uplift is seen in the vertical force. The buoyancy effect is doubled. In addition, the DTR cell and L3+ mechanism of the invention are more effective at dispersing gas and keeping solids in motion than the compared apparatus.

What is claimed is:

1. A flotation cell for the flotation of a mineral slurry and a flotation mechanism located in the flotation cell, the flotation cell gradually widening upwards and comprising a cylindrical lower section, a middle section above it in the shape of a truncated cone and a cylindrical upper section attached to the top of the middle section, where the diameter of the cylindrical lower section is ⅓–⅔ of the diameter of the cylindrical upper section, the flotation cell being equipped with vertical flow guides, that extend from the lower section of the cell into the upper section of the cell; the flotation mechanism placed in the flotation cell comprising a directional element suspended from the bottom end of a hollow shaft which extends into the lower section of the cell, and vertical vanes attached to the directional element, that extend above and below the directional element, and the directional element comprises an essentially horizontal circular plate attached at the center symmetrically around the shaft, the outer edge of the central plate being bent downwards to form a lap of a guiding part, and a gas-spreading element being located on the inside of the directional element lap.

2. The flotation cell according to claim 1, having the flotation mechanism, wherein the vertical vanes extend beyond the directional element by a distance which is ⅓–⅔ of the width of the directional element lap.

3. The flotation cell according to claim 1, having the flotation mechanism, wherein the downward bent lap of the directional element forms a 30–60° angle with the horizontal.

4. The flotation cell according to claim 1, having the flotation mechanism, wherein the width of the directional element lap is ½–⅙ that of the diameter of the directional element.

5. The flotation cell according to claim 1, having the flotation mechanism, wherein the width of the vertical vanes is greater than that of the directional element lap.

6. The flotation cell according to claim 1, having the flotation mechanism, wherein the vertical vanes are attached radially to the directional element circular plate.

7. The flotation cell according to claim 1, having the flotation mechanism, wherein an outer edge of the vertical vane is vertical and an inner edge is vertical at the top and narrows in an outward curve at the bottom.

8. The flotation cell according to claim 7, having the flotation mechanism, wherein the curve of the bottom of the inner edge of the vertical vane follows the shape of a circular arc, where the centre point of the circle is the intersection of the outer edge of the guide lap and the vertical vane.

9. The flotation cell according to claim 1, having the flotation mechanism, wherein the gas-spreading element is a circular plate.

10. The flotation cell according to claim 1, having the flotation mechanism, wherein the diameter of the gas-spreading element is between that of the horizontal circular plate and that of the mixing mechanism shaft.

11. The flotation cell according to claim 1, having the flotation mechanism, wherein the distance of the gas-spreading element from the circular plate is between ½–⅙ times the diameter of the mixing mechanism shaft.

12. The flotation cell according to claim 1, having the flotation mechanism, wherein the hollow shaft of the flotation mechanism acts as a gas feed device.

13. The flotation cell according to claim 1, wherein the truncated cone of the middle section forms a 30–60° angle with the vertical axis.

* * * * *